US009776236B2

(12) United States Patent
Suzuki et al.

(10) Patent No.: US 9,776,236 B2
(45) Date of Patent: Oct. 3, 2017

(54) CENTER HOLE FORMING METHOD AND FORGING DEVICE

(71) Applicant: TOYOTA JIDOSHA KABUSHIKI KAISHA, Toyota-shi (JP)

(72) Inventors: Toshitaka Suzuki, Okazaki (JP); Teruki Kameda, Nissin (JP); Yasutaka Ido, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/023,259

(22) PCT Filed: Sep. 10, 2014

(86) PCT No.: PCT/IB2014/001779

§ 371 (c)(1),
(2) Date: Mar. 18, 2016

(87) PCT Pub. No.: WO2015/040461

PCT Pub. Date: Mar. 26, 2015

(65) Prior Publication Data

US 2016/0236265 A1 Aug. 18, 2016

(30) Foreign Application Priority Data

Sep. 18, 2013 (JP) ..... 2013-193330

(51) Int. Cl.
*B21J 5/00* (2006.01)
*B21J 5/06* (2006.01)
(Continued)

(52) U.S. Cl.
CPC ..... *B21J 5/002* (2013.01); *B21C 23/01* (2013.01); *B21J 5/06* (2013.01); *B21J 5/12* (2013.01); *B21J 13/025* (2013.01)

(58) Field of Classification Search
CPC ..... B21J 5/06; B21J 5/025; B21J 5/12; B21J 13/025; B21J 5/10; B21J 9/022; B21C 23/01
See application file for complete search history.

(56) References Cited

U.S. PATENT DOCUMENTS

2012/0111141 A1 5/2012 Shibutani et al.
2015/0013420 A1 1/2015 Shibutani et al.

FOREIGN PATENT DOCUMENTS

CN 102472379 A 5/2012
JP 62-077144 A 4/1987
(Continued)

OTHER PUBLICATIONS

Partial English Translation of Japanese Office Action dated Jul. 21, 2015 in Japanese Patent Application 2013-193330 filed Sep. 13, 2013.

(Continued)

*Primary Examiner* — Debra Sullivan
(74) *Attorney, Agent, or Firm* — Oblon, McClelland, Maier & Neustadt, L.L.P.

(57) ABSTRACT

In a center hole forming method, an object to be processed is inserted in a die hole and a shaft is drawn from the object. A load toward a first axial end surface of the object is applied to a second axial end surface of the object without taking out the object from the die hole. A diameter of the first axial end surface is smaller than a diameter of the second axial end surface. A center hole is formed in the first axial end surface by pressing a counter punch against the first axial end surface in a state that the load is applied to the second axial end surface.

12 Claims, 10 Drawing Sheets

(51) Int. Cl.

| | |
|---|---|
| ***B21J 5/12*** | (2006.01) |
| ***B21J 13/02*** | (2006.01) |
| ***B21C 23/01*** | (2006.01) |

(56) References Cited

FOREIGN PATENT DOCUMENTS

| | | | |
|---|---|---|---|
| JP | 63-145533 | U | 9/1988 |
| JP | 2003-136180 | A | 5/2003 |
| JP | 2003-311364 | A | 11/2003 |
| JP | 2008-246509 | A | 10/2006 |
| JP | 2010-017728 | A | 1/2010 |

OTHER PUBLICATIONS

International Search Report dated Feb. 9, 2015 in PCT/IB14/01779 filed Sep. 10, 2014.

CENTER HOLE FORMING METHOD AND FORGING DEVICE

BACKGROUND OF THE INVENTION

1. Field of the Invention

The present invention relates to a center hole forming method and a forging device.

2. Description of Related Art

As a technique of this kind, Japanese Patent Application Publication No. 62-77144 (JP 62-77144 A) discloses a method of obtaining a first intermediate product by subjecting an object to be processed, which is inserted in a die hole, to shank extruding and then forming a center hole in both axial end surfaces of the first intermediate product without taking out the first intermediate product from the die. More specifically, a pair of second press dies is inserted in the die, so as to hold the first intermediate product from above and below. A center hole forming die is projected and provided in each of pressing surfaces of the pair of second press dies. By moving the pair of second press dies toward the first intermediate product, the center hole is formed in both axial end surfaces of the first intermediate product.

However, in the method disclosed in JP 62-77144 A, there is no description on timing to move the each second press die when the pair of second press dies is moved toward the first intermediate product. For example, if the second press die on a small diameter side of the pair of second press dies first contacts the axial end surface on the small diameter side of the first intermediate product, the first intermediate product may float in the die hole, and consequently, the center hole may not be well-formed in the axial end surface in the small diameter side of the first intermediate product.

SUMMARY OF THE INVENTION

The present invention provides a center hole forming method and a forging device, each of which subjects an object inserted in a die hole to shank extruding, and then, without taking out the object from the die hole, reliably forms a center hole in a small end surface that is the axial end surface on the small diameter side of the object.

A center hole forming method according to a first aspect of the present invention includes: inserting an object to be processed in a die hole and drawing a shaft from the object; applying a load toward a first axial end surface of the object to a second axial end surface of the object without taking out the object from the die hole; and forming a center hole in the first axial end surface by pressing a counter punch against the first axial end surface in a state that the load is applied to the second axial end surface. A diameter of the first axial end surface is smaller than a diameter of the second axial end surface. According to the center hole forming method just as described, when the counter punch is pressed against the first axial end surface to form the center hole in the first axial end surface, the object to be processed is suppressed from moving in the die hole by pressing of the counter punch. Thus, the center hole can reliably be formed in the first axial end surface. The center hole forming method may further include prohibiting the counter punch from moving beyond a specified position toward the object when the counter punch reaches the specified position while the counter punch is pressed against the first axial end surface to form the center hole in the first axial end surface. According to the center hole forming method just as described, precision of a relative position in the axial direction of the center hole to the second axial end surface is secured.

A forging device according to a second aspect of the present invention includes a first die, a second die, a die drive section, a counter punch, a counter punch drive section, and a controller. The first die has a die hole for shank extruding. The second die is arranged in a large diameter side of the die hole and is configured to apply a load to an object to draw a shaft from the object, the object being inserted in the die hole. The die drive section is configured to drive the second die. The counter punch is arranged in a small diameter side of the die hole and is configured to be pressed against a first axial end surface of the object to form a center hole in the first axial end surface. The counter punch drive section is configured to drive the counter punch. The controller is configured to control the die drive section and the counter punch drive section. The controller is configured to control the die drive section and the counter punch drive section to apply a load toward the first axial end surface to a second axial end surface of the object by the second die. Furthermore, the controller is configured to control the die drive section and the counter punch drive section to form the center hole in the first axial end surface by the counter punch in a state that the load is applied to the second axial end surface. A diameter of the first axial end surface is smaller than a diameter of the second axial end surface. According to the above forging device, when the counter punch is pressed against the first axial end surface to form the center hole in the first axial end surface, the object to be processed is suppressed from moving in the die hole by the pressing of the counter punch. Thus, the center hole can reliably be formed in the first axial end surface. The forging device may further include a movement control mechanism that is configured to prohibit the counter punch from moving beyond a specified position toward the object when the counter punch reaches the specified position while the counter punch is pressed against the first axial end surface to form the center hole in the first axial end surface. According to the above forging device, precision of a relative position in the axial direction of the center hole to the second axial end surface is secured. The movement control mechanism may be configured to be switchable between a movement prohibition state and a movement permission state. In the movement prohibition state, once the counter punch reaches the specified position, the counter punch is prohibited from moving beyond the specified position toward the object. In the movement permission state, even after the counter punch reaches the specified position, the counter punch is permitted to move beyond the specified position toward the object. According to the above forging device, when the movement control mechanism is switched from the movement prohibition state to the movement permission state, the object to be processed can be taken out from the die hole by using the counter punch. The movement control mechanism may be switched into the movement prohibition state in conjunction with the second die approaching the first die. Furthermore, the movement control mechanism may be switched into the movement permission state in conjunction with the second die separating from the first die. According to the above forging device, steps of switching the states of the movement control mechanism can be saved.

According to the first and second aspects of the present invention, when the counter punch is pressed against the first axial end surface to form the center hole in the first axial end surface, the object to be processed does not move in the die hole by the pressing of the counter punch. Thus, the center hole can reliably be formed in the first axial end surface.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
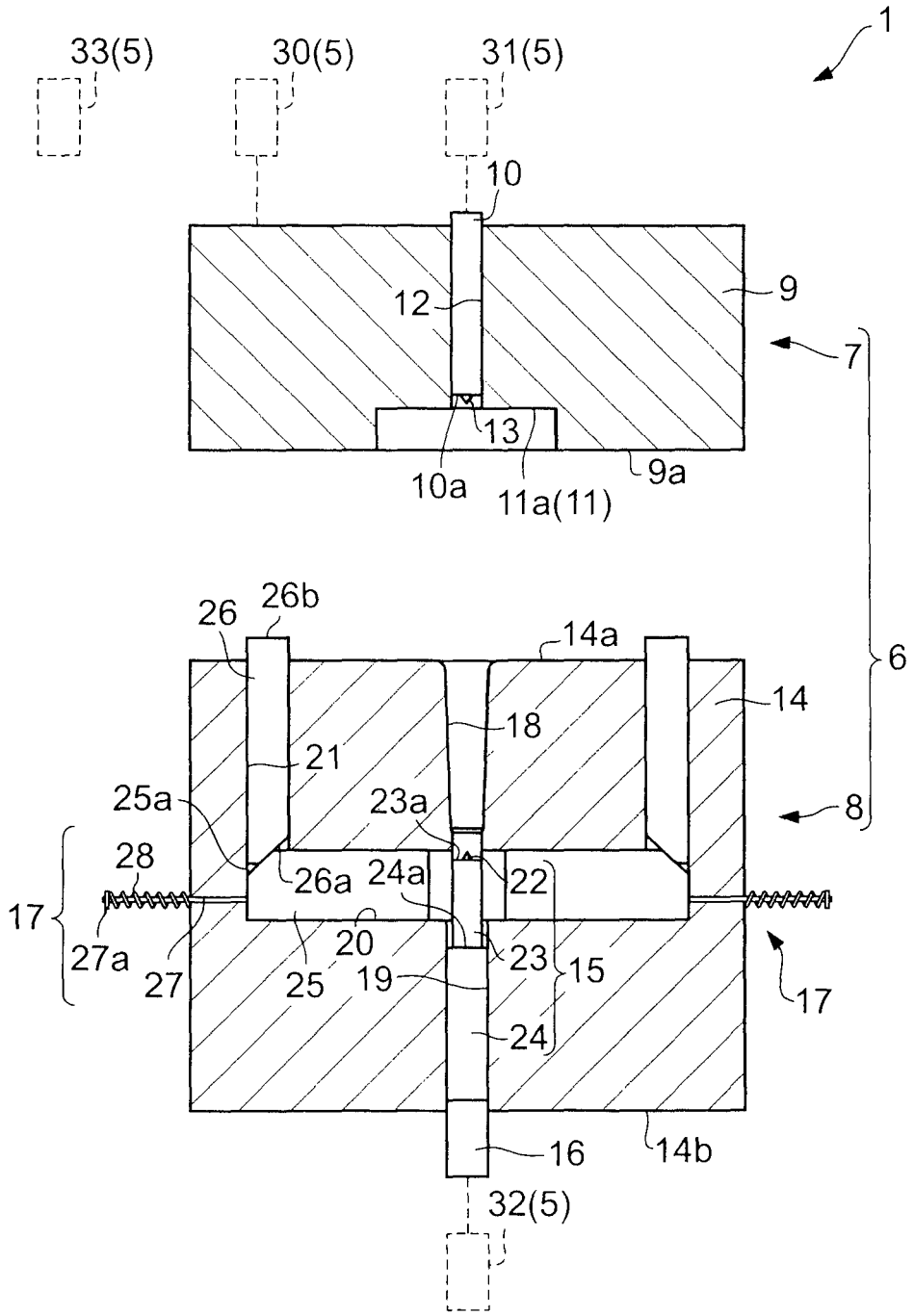
FIG. 1 is a cross-sectional view of a forging device of an embodiment of the present invention in a state that a die is opened.

A description will hereinafter be made on a forging device 1 and an object to be processed 2 with reference to FIG. 1 and FIG. 2. As shown in FIG. 2, in this embodiment, the object 2 has a shaft section 3 and a head section 4. The forging device 1 subjects the shaft section 3 of the object 2 to shank extruding, forms a shaft section center hole 3*b* (a center hole in a small diameter side, a center hole) in a shaft section end surface 3*a* (an end surface on a small diameter side) that is the axial end surface on the small diameter side of the object 2, and forms a head section center hole 4*b* (a center hole on a large diameter side) in a head section end surface 4*a* (an end surface on the large diameter side) that is the axial end surface on the large diameter side of the object 2. The shaft section end surface 3*a* may be regarded as the first axial end surface of the present invention. The head section end surface 4*a* may be regarded as the second axial end surface of the present invention.

Figure 2:
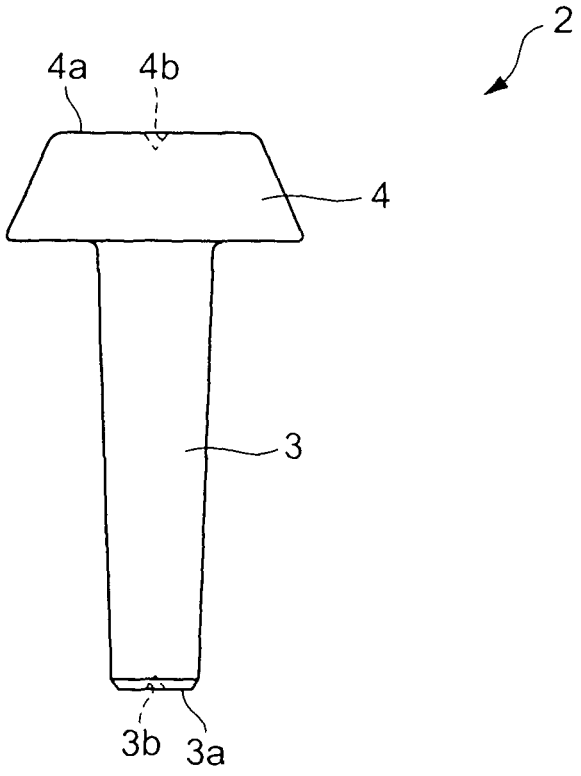
FIG. 2 is a front view of an object to be processed of the embodiment of the present invention.

As shown in FIG. 1, the forging device 1 includes a press machine 5 and a die 6.

(Die 6) The die 6 has an upper die unit 7 and a lower die unit 8.

The upper die unit 7 has an upper die 9 (the second die) and a punch 10. A head section housing recess section 11 that houses the head section 4 of the object 2 is formed in a lower surface 9*a* of the upper die 9. The upper die 9 has a press load surface 11*a* that partitions an upper side of the head section housing recess section 11. The upper die 9 has a punch housing hole 12 that extends in a vertical direction. The punch housing hole 12 is opened to the press load surface 11*a*. The punch 10 is housed in the punch housing hole 12 of the upper die 9 in a manner movable in the vertical direction. A center hole forming projection 13 that is projected downward is formed in a lower end surface 10*a* of the punch 10.

The lower die unit 8 has a lower die 14 (the first die), a counter punch 15, a knock-out pin 16, and a pair of counter punch operation control mechanisms 17. The counter punch operation control mechanism 17 may be regarded as the movement control mechanism of the present invention.

The lower die 14 has an upper surface 14*a* and a lower surface 14*b*. The upper surface 14*a* of the lower die 14 opposes the lower surface 9*a* of the upper die 9 in the vertical direction. The lower die 14 has a die hole 18 for the shank extruding and a counter punch housing hole 19. The die hole 18 is formed to extend in the vertical direction and opened to the upper surface 14*a* of the lower die 14. The counter punch housing hole 19 extends in the vertical direction and is opened to the lower surface 14*b* of the lower die 14. The die hole 18 and the counter punch housing hole 19 are connected in the vertical direction. The lower die 14 further has a horizontally moving block housing hole 20 and a perpendicularly moving block housing hole 21. The horizontally moving block housing hole 20 extends in a horizontal direction and is connected to the counter punch housing hole 19. The perpendicularly moving block housing hole 21 extends in a perpendicular direction, is connected to the horizontally moving block housing hole 20, and is opened to the upper surface 14*a* of the lower die 14.

The counter punch 15 is housed in the counter punch housing hole 19 of the lower die 14 in a manner movable in the vertical direction. The counter punch 15 has a center hole forming projection 22, a small diameter section 23, and a large diameter section 24. The center hole forming projection 22, the small diameter section 23, and the large diameter section 24 are aligned in this order from top down. The center hole forming projection 22 is projected upward from an upper end surface 23*a* of the small diameter section 23. The small diameter section 23 has a smaller diameter than the large diameter section 24. Thus, the large diameter section 24 has an upper end surface 24*a*.

The knock-out pin 16 is arranged below the counter punch 15.

The each counter punch operation control mechanism 17 is constituted by including a horizontally moving block 25, a perpendicularly moving block 26, a rod 27, and a compression coil spring 28. The horizontally moving block 25 is housed in the horizontally moving block housing hole 20 of the lower die 14 in a manner movable in the horizontal direction. An inclined surface 25*a* that is inclined at about 45 degrees to the axial direction is formed at one end of the horizontally moving block 25. The perpendicularly moving block 26 is housed in the perpendicularly moving block housing hole 21 of the lower die 14 in a manner movable in the perpendicular direction. An inclined surface 26*a* that is inclined at about 45 degrees to the axial direction is formed at a lower end of the perpendicularly moving block 26. The inclined surface 25*a* of the horizontally moving block 25 and the inclined surface 26*a* of the perpendicularly moving block 26 are in surface contact with each other. The rod 27 and the compression coil spring 28 cooperatively pull the horizontally moving block 25 in a direction to separate from the counter punch housing hole 19. The rod 27 extends in the horizontal direction from the horizontally moving block 25 and penetrates the lower die 14. The compression coil spring 28 is arranged between a tip 27*a* of the rod 27 and the lower die 14. Due to a spring return force of the compression coil spring 28, the horizontally moving block 25 is pulled in the direction to separate from the counter punch housing hole 19. Here, in a state shown in FIG. 1, since the horizontally moving block 25 is pulled in the direction to separate from the counter punch housing hole 19, the perpendicularly moving block 26 is lifted upward. Accordingly, an upper end surface 26*b* of the perpendicularly moving block 26 is located above the upper surface 14*a* of the lower die 14.

(Press Machine 5) The press machine 5 includes an upper die drive section 30 of hydraulic drive type that drives the upper die 9 in the vertical direction, a punch drive section 31 of hydraulic drive type that drives the punch 10 in the vertical direction, a knock-out pin drive section 32 of hydraulic drive type that drives the counter punch 15 in the vertical direction by driving the knock-out pin 16 in the vertical direction, and a controller 33. The controller 33 controls the upper die drive section 30, the punch drive section 31, and the knock-out pin drive section 32. The controller 33 is configured to restrict movement of the object 2 in the die hole 18 that is caused by pressing of the counter punch 15 before forming the shaft section center hole 3*b* in the shaft section end surface 3*a* by pressing the counter punch 15 against the shaft section end surface 3*a* of the object 2. More specifically, the controller 33 is configured to control the upper die drive section 30 and the knock-out pin drive section 32 such that the upper die 9 applies a load in a direction toward the shaft section end surface 3*a* to the head section end surface 4*a* of the object 2 in advance. The upper die drive section 30 may be regarded as the die drive section of the present invention. The knock-out pin drive section 32 may be regarded as the counter punch drive section.

Figure 3:
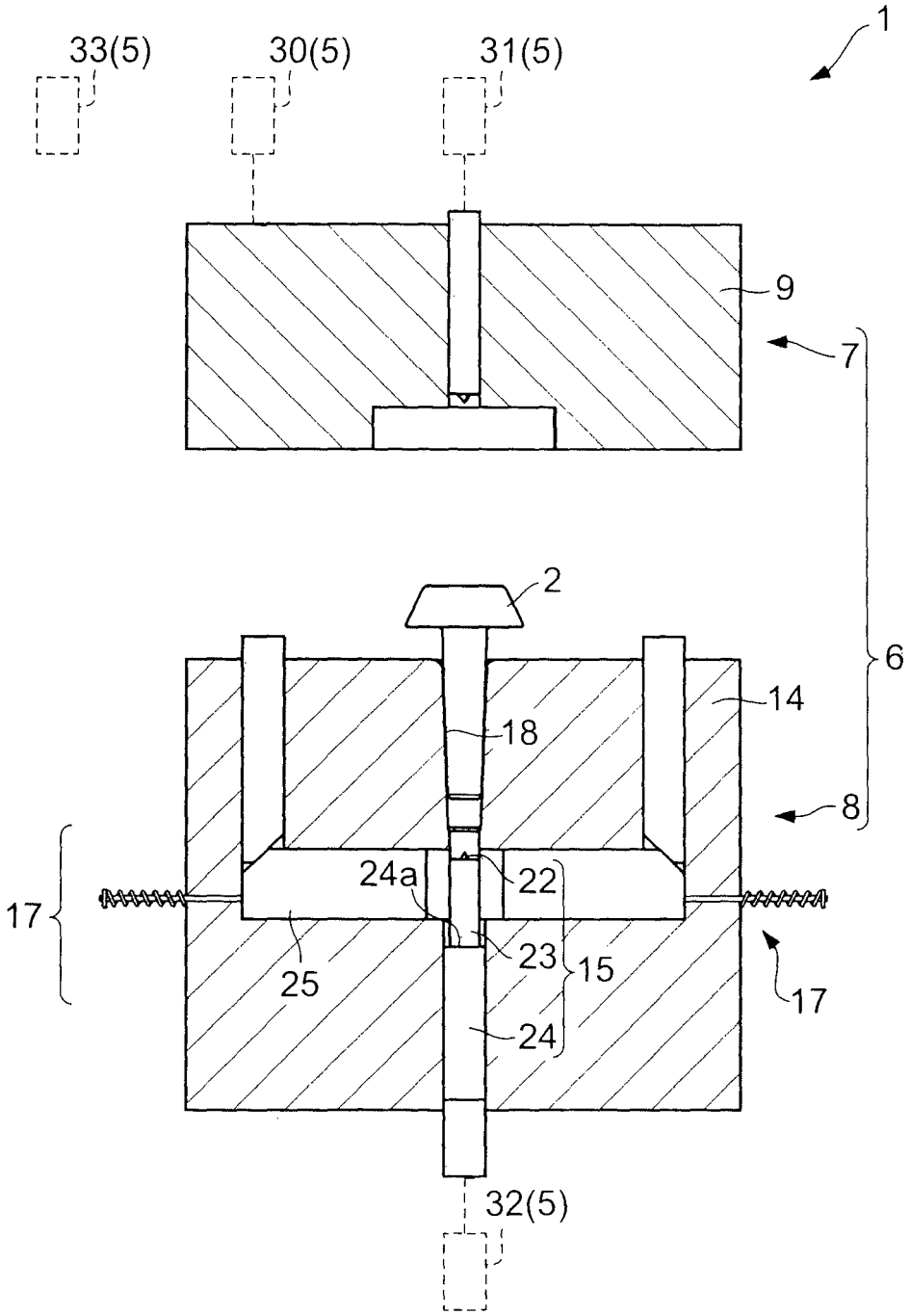
FIG. 3 is a cross-sectional view of the forging device in a state that the object to be processed is set in a die hole.

Next, with reference to FIG. 3 to FIG. 10, an operation of the forging device 1 will be described. FIG. 3 shows a state that the upper die unit 7 is in an upper position and that the object 2 is set in the die hole 18 of the lower die 14 of the lower die unit 8. In FIG. 3, the counter punch operation control mechanism 17 is in a movement permission state. The movement permission state means a state that the horizontally moving block 25 does not oppose the upper end surface 24*a* of the large diameter section 24 of the counter punch 15 in the vertical direction and thus that the horizontally moving block 25 does not block upward movement of the counter punch 15 above a specified position.

Figure 4:
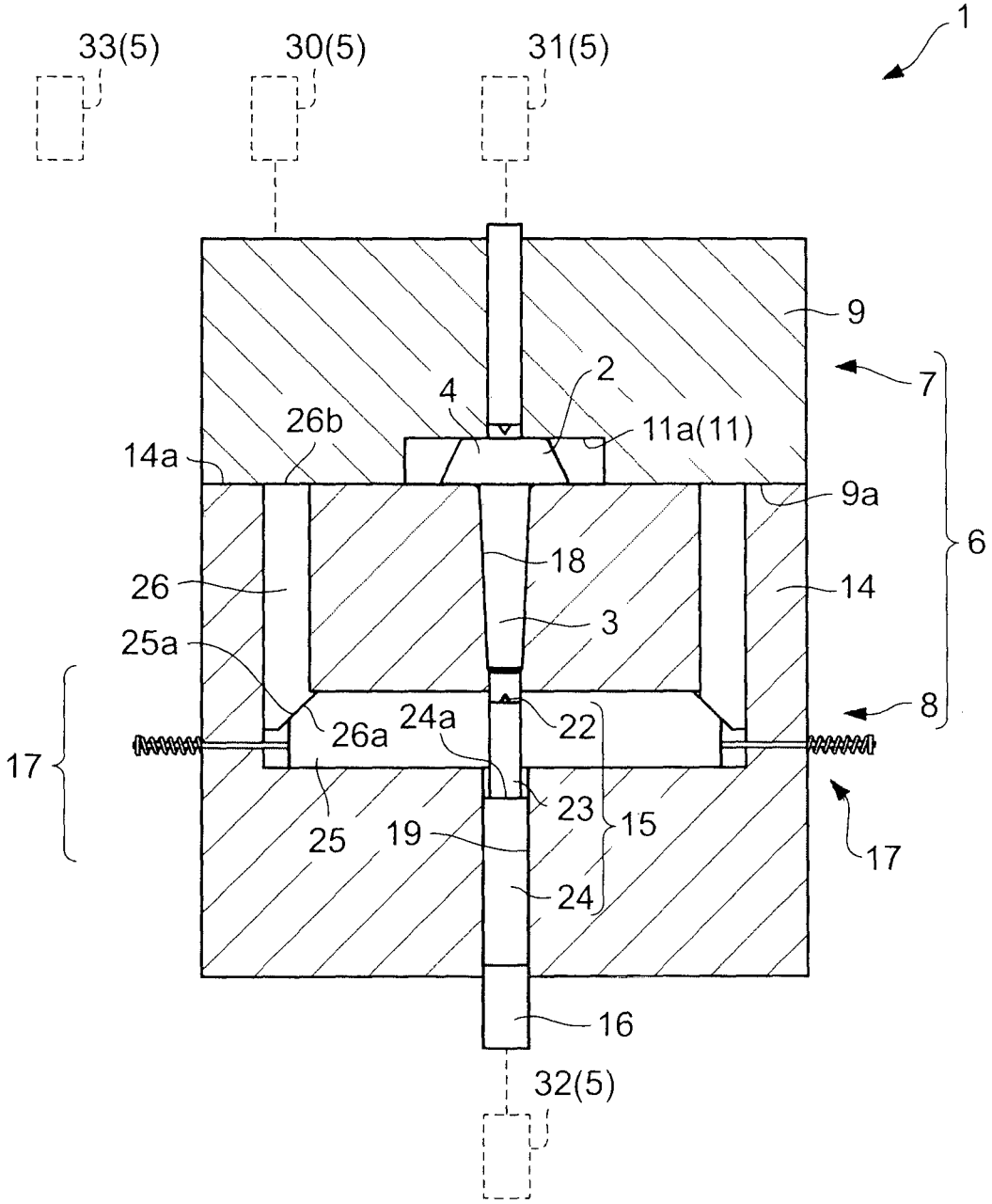
FIG. 4 is a cross-sectional view of the forging device in a state that the object to be processed is subjected to shank extruding.

In this state, the controller 33 controls the upper die drive section 30 to cause the upper die 9 to move downwardly toward the lower die 14. Accordingly, as shown in FIG. 4, the head section 4 of the object 2 is housed in the head section housing recess section 11 of the upper die 9. The shaft section 3 of the object 2 is subjected to the shank extruding in the die hole 18 of the lower die 14. The head section 4 of the object 2 is slightly crushed in the vertical direction by the press load surface 11*a* of the upper die 9. The downward movement of the upper die 9 is finished when the lower surface 9*a* of the upper die 9 collides with the upper surface 14*a* of the lower die 14. Even after the lower surface 9*a* of the upper die 9 collides with the upper surface 14*a* of the lower die 14, the controller 33 keeps controlling the upper die drive section 30, so as to continuously press the upper die 9 against the lower die 14.

As shown in FIG. 4, when the upper die 9 approaches the lower die 14, the lower surface 9*a* of the upper die 9 is brought into contact with the upper end surface 26*b* of the perpendicularly moving block 26 of the counter punch operation control mechanism 17, and then the perpendicularly moving block 26 is pushed down. Once the perpendicularly moving block 26 is pushed down, the horizontally moving block 25 moves toward the counter punch housing hole 19 due to the interaction of the inclined surface 26*a* of the perpendicularly moving block 26 and the inclined surface 25*a* of the horizontally moving block 25. Consequently, the counter punch operation control mechanism 17 is brought into a movement prohibition state. The movement prohibition state means a state that the horizontally moving block 25 opposes the upper end surface 24*a* of the large diameter section 24 of the counter punch 15 in the vertical direction and thus that the horizontally moving block 25 blocks the upward movement of the counter punch 15 above the specified position.

Figure 5:
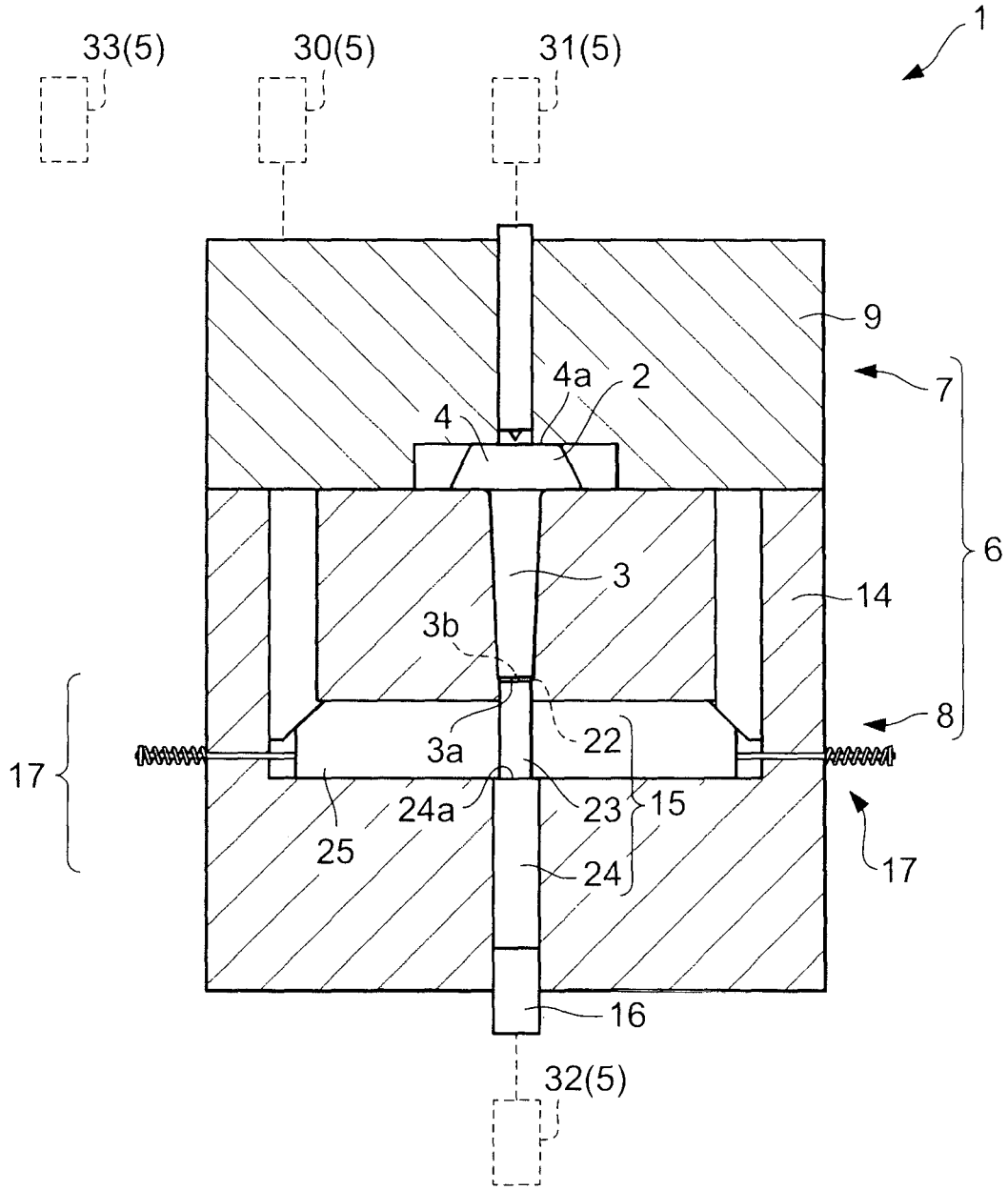
FIG. 5 is a cross-sectional view of the forging device in a state that a center hole is formed by a counter punch.

Next, the controller 33 controls the knock-out pin drive section 32 and causes the knock-out pin 16 to move upward. Then, as shown in FIG. 5, in conjunction with the upward movement of the knock-out pin 16, the counter punch 15 also moves upward. Then, the center hole forming projection 22 of the counter punch 15 digs into the shaft section end surface 3*a* of the shaft section 3 of the object 2, and the shaft section center hole 3*b* is formed in the shaft section end surface 3*a* of the shaft section 3. In addition, since the counter punch operation control mechanism 17 is in the movement prohibition state, the upward movement of the counter punch 15 above the specified position is prohibited. More specifically, when the counter punch 15 moves upward, and the upper end surface 24*a* of the large diameter section 24 of the counter punch 15 is brought into contact with the horizontally moving block 25, the further upward movement of the counter punch 15 is prohibited. Thus, the precision of a relative position of the shaft section center hole 3*b* to the head section end surface 4*a* is secured. Here, the position of the shaft section center hole 3*b* can be defined uniformly by a tip of a cone that is identified by inner peripheral surface in a conical shape of the shaft section center hole 3*b*, for example.

Figure 6:
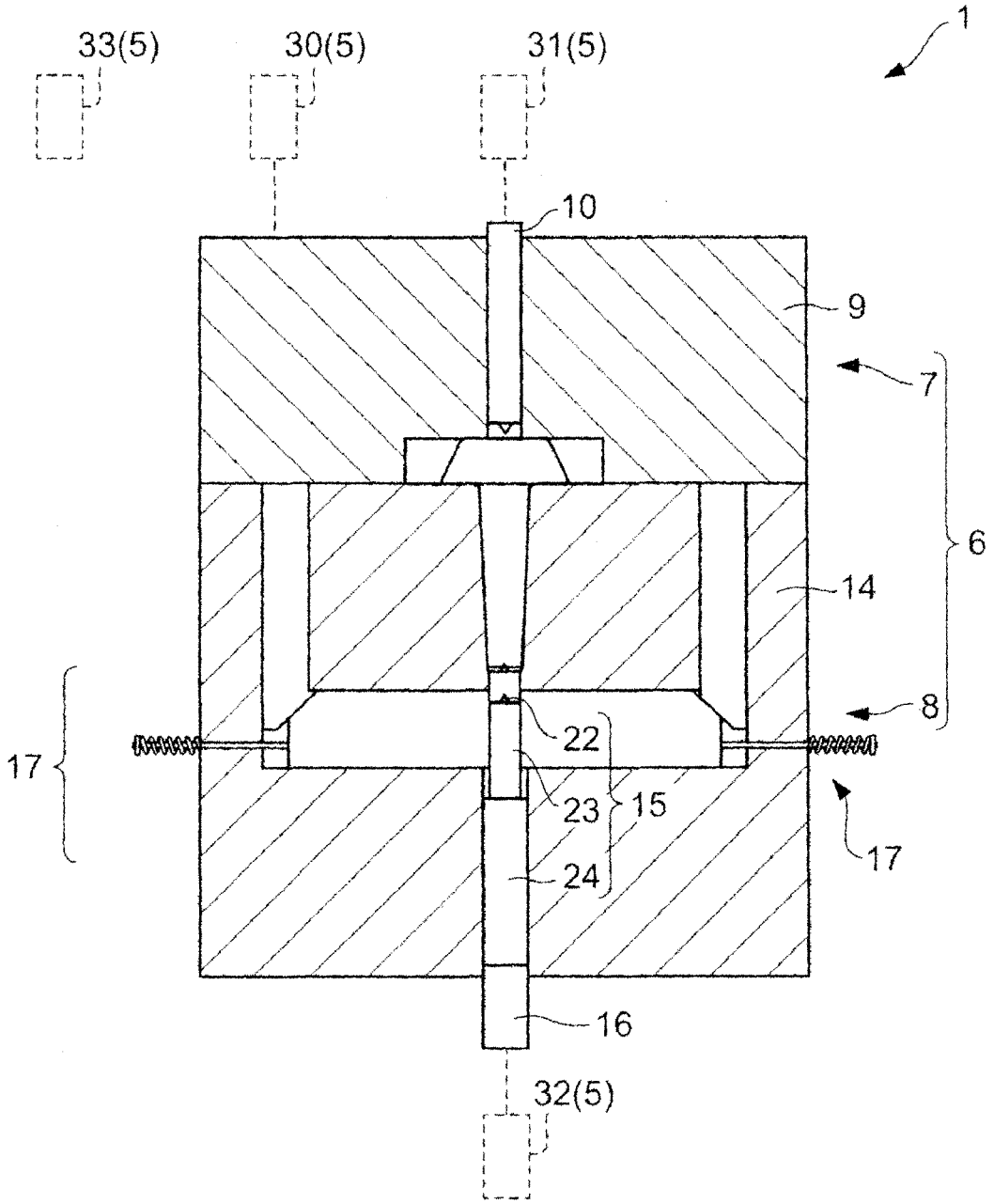
FIG. 6 is a cross-sectional view of the forging device in a state that the counter punch is withdrawn.

Next, the controller 33 controls the knock-out pin drive section 32 and causes the knock-out pin 16 to move downward. Then, as shown in FIG. 6, in conjunction with the downward movement of the knock-out pin 16, the counter punch 15 also moves downward.

Figure 7:
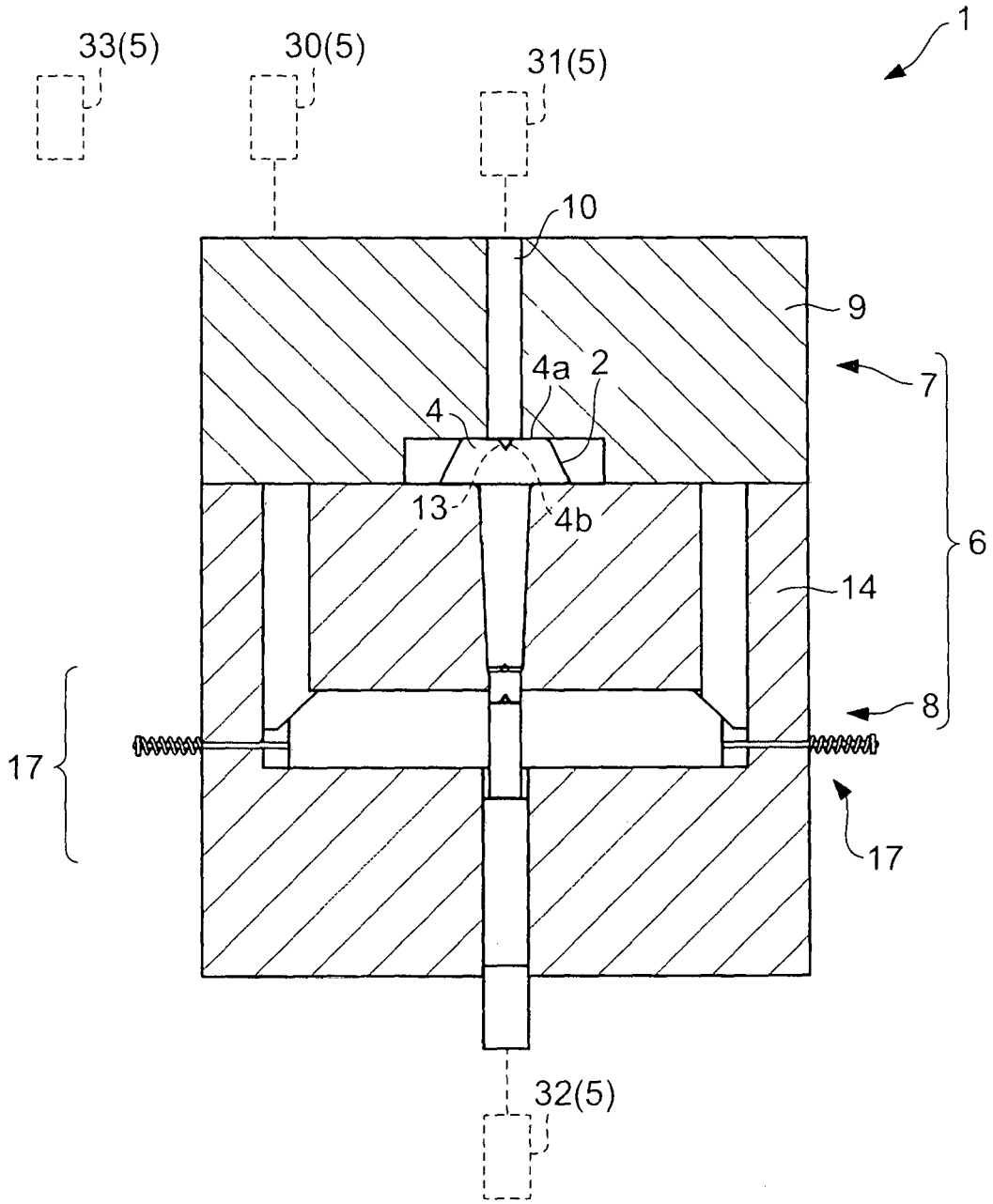
FIG. 7 is a cross-sectional view of the forging device in a state that a center hole is formed by a punch.

Next, the controller 33 controls the punch drive section 31 and causes the punch 10 to move downward. Then, as shown in FIG. 7, the center hole forming projection 13 of the punch 10 digs into the head section end surface 4*a* of the head section 4 of the object 2, and the head section center hole 4*b* is formed in the head section end surface 4*a* of the head section 4 of the object 2.

Figure 8:
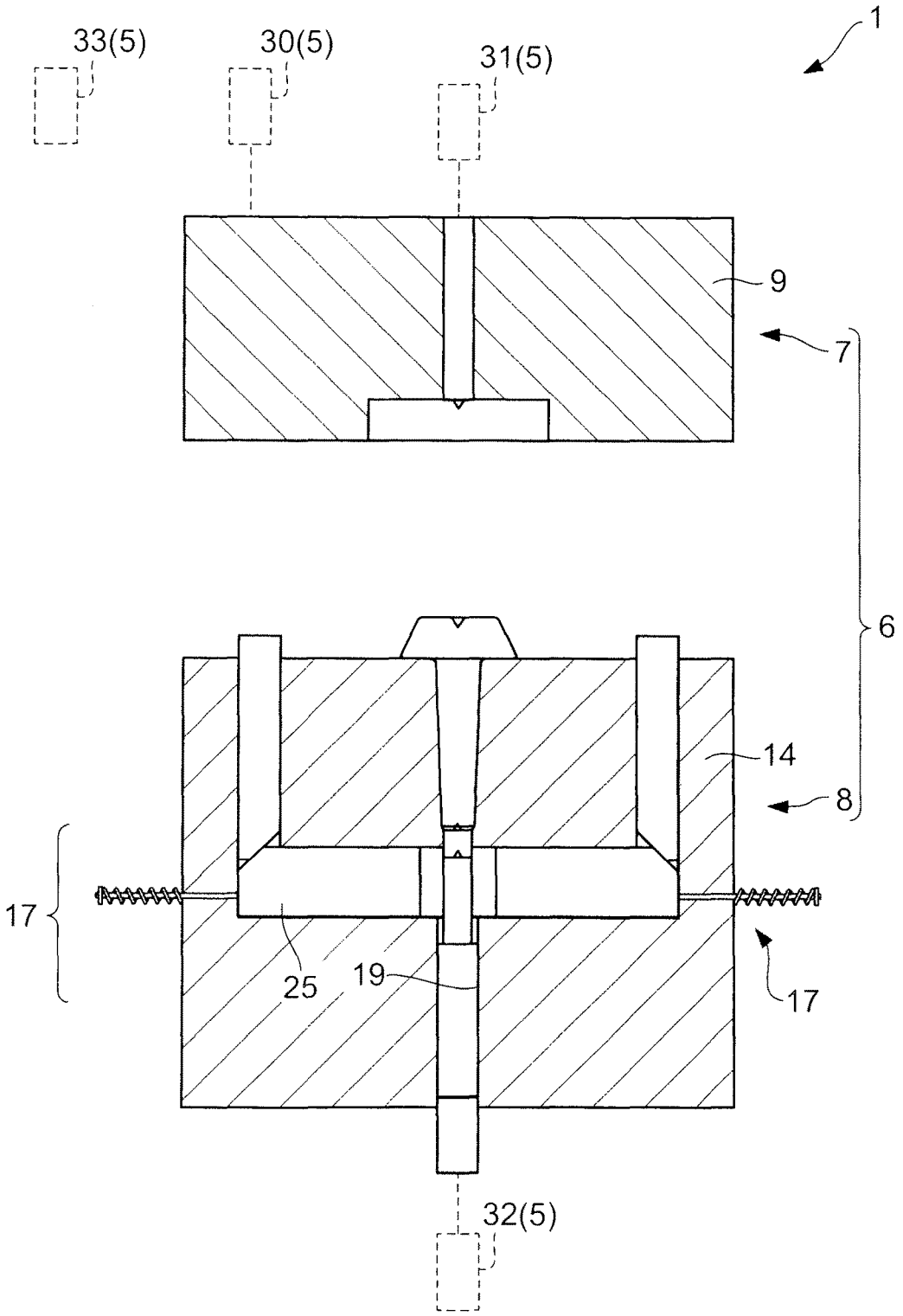
FIG. 8 is a cross-sectional view of the forging device in a state that an upper die is moved upward.

Next, the controller 33 controls the upper die drive section 30 to cause the upper die 9 to move upward, so as to separate from the lower die 14. As shown in FIG. 8, when the upper die 9 separate from the lower die 14, the horizontally moving block 25 moves so as to separate from the counter punch housing hole 19. Consequently, the counter punch operation control mechanism 17 is brought into the movement permission state.

Figure 9:
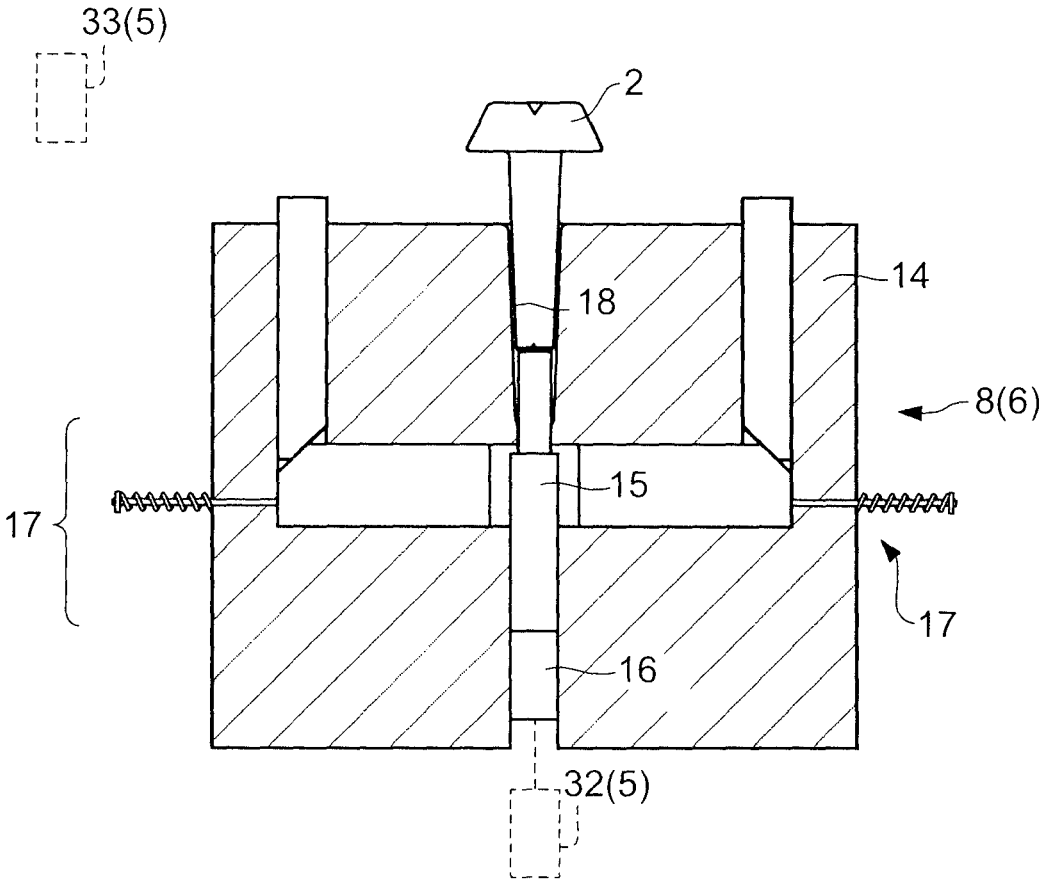
FIG. 9 is a cross-sectional view of the forging device and shows that the object to be processed is drawn out of the die hole by the counter punch.

Next, the controller 33 controls the knock-out pin drive section 32 to cause the knock-out pin 16 to move upward. Then, as shown in FIG. 9, in conjunction with the upward movement of the knock-out pin 16, the counter punch 15 also moves upward. At this time, since the counter punch operation control mechanism 17 is switched to be in the movement permission state, the upward movement of the counter punch 15 is not limited by the horizontally moving block 25. When the counter punch 15 moves upward, the object 2 is extruded upward from the die hole 18.

Figure 10:
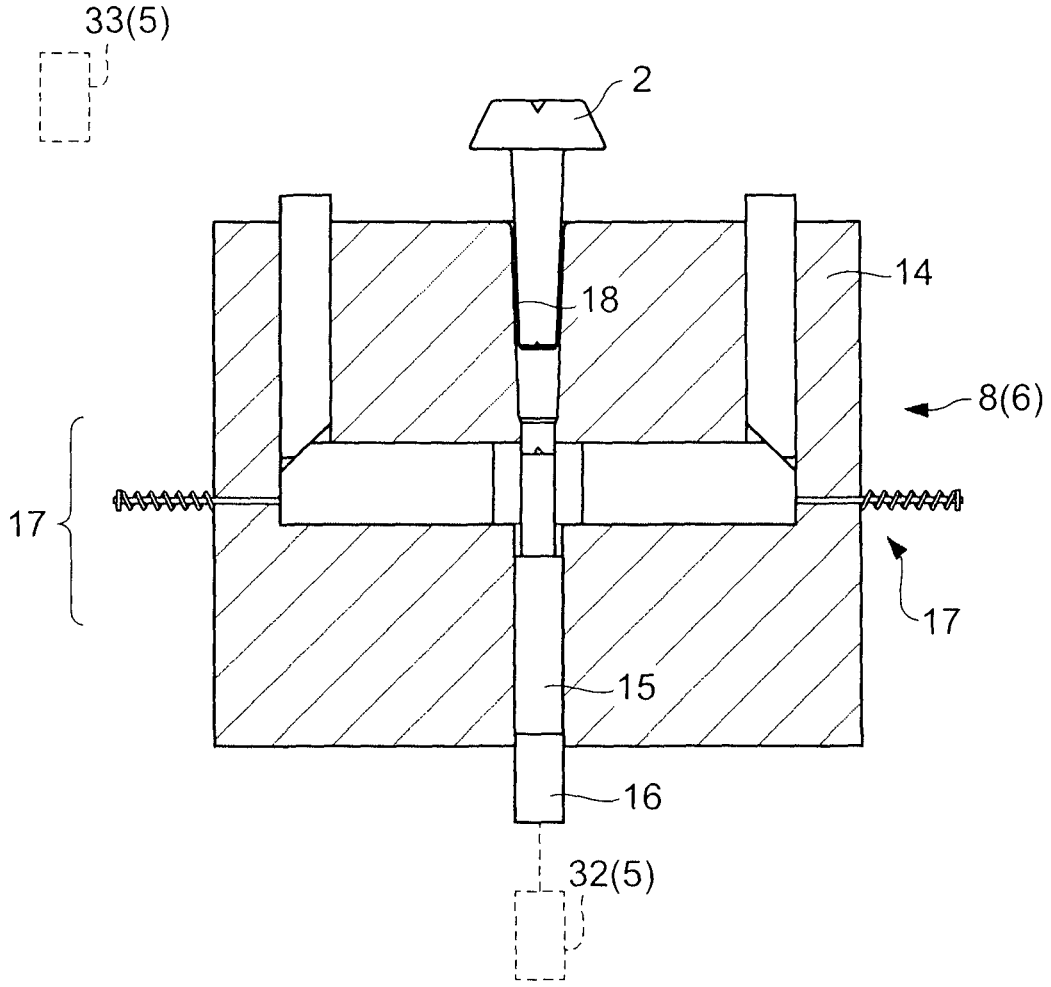
FIG. 10 is a cross-sectional view of the forging device and shows that the object to be processed has been drawn out of the die hole by the counter punch.

Next, the controller 33 controls the knock-out pin drive section 32 to cause the knock-out pin 16 to move downward. Then, as shown in FIG. 10, in conjunction with the downward movement of the knock-out pin 16, the counter punch 15 also moves downward. In a state shown FIG. 10, a worker of the forging device 1 removes and collects the object 2 from the die hole 18.

A description has been made so far on the embodiment of the invention of the subject application. The above-described embodiment has following features.

(1) A center hole forming method, in which the object 2 that is inserted in the die hole 18 is subjected to the shank extruding and then, without taking out the object 2 from the die hole 18, the shaft section center hole 3*b* (the center hole) is formed in the shaft section end surface 3*a* (the end surface on the small diameter side) that is the axial end surface on the small diameter side of the object 2, is performed as follows. More specifically, before forming the shaft section center hole 3*b* in the shaft section end surface 3*a* by pressing the counter punch 15 against the shaft section end surface 3*a*, a load toward the shaft section end surface 3*a* is applied in advance to the head section end surface 4*a* (the end surface on the large diameter side) that is the axial end surface on the large diameter side of the object 2 so that the object 2 does not move in the die hole 18 by being the pressing of the counter punch 15. According to the method just as described, when the counter punch 15 is pressed against the shaft section end surface 3*a* to form the shaft section center hole 3*b* in the shaft section end surface 3*a*, the object 2 is restricted from moving in the die hole 18 by the pressing of the counter punch 15. Thus, the shaft section center hole 3*b* can reliably be formed in the shaft section end surface 3*a*.

(2) The counter punch 15 is pressed against the shaft section end surface 3*a* to form the shaft section center hole 3*b* in the shaft section end surface 3*a*. At this time, once the counter punch 15 reaches the specified position, the movement of the counter punch 15 beyond the specified position toward the shaft section end surface 3*a* of the shaft section 3 of the object 2 is prohibited. According to the method just as described, the precision of the relative position in the axial direction of the shaft section center hole 3*b* to the head section end surface 4*a* is secured.

(3) The forging device 1 includes the lower die 14 (the first die), the upper die 9 (the second die), the counter punch 15, the knock-out pin drive section 32 (the counter punch drive section), and the controller 33. The lower die 14 has the die hole 18 for the shank extruding. The upper die 9 is arranged in the large diameter side of the die hole 18 and is configured to apply the load to the object 2 that is inserted in the die hole 18 so as to draw the shaft section from the object 2. The upper die drive section 30 is configured to drive the upper die 9. The counter punch 15 is arranged in the small diameter side of the die hole 18 and is configured to be pressed against the shaft section end surface 3*a* that is the axial end surface on the small diameter side of the object 2 so as to form the shaft section center hole 3*b* in the shaft section end surface 3*a*. The knock-out pin drive section 32 is configured to drive the counter punch 15. The controller 33 is configured to control the upper die drive section 30 and the knock-out pin drive section 32. The controller 33 is configured to restrict the object 2 from moving in the die hole 18 by the pressing of the counter punch 15 before the counter punch 15 is pressed against the shaft section end surface 3*a* to form the shaft section center hole 3*b* in the shaft section end surface 3*a*. More specifically, the controller 33 is configured to control the upper die drive section 30 and the knock-out pin drive section 32 such that the upper die 9 applies in advance the load toward the shaft section end surface 3*a* to the head section end surface 4*a* that is the axial end surface on the large diameter side of the object 2. According to the configuration just as described, when the counter punch 15 is pressed against the shaft section end surface 3*a* to form the shaft section center hole 3*b* in the shaft section end surface 3*a*, the object 2 is restricted from moving in the die hole 18 by the pressing of the counter punch 15. Thus, the shaft section center hole 3*b* can reliably be formed in the shaft section end surface 3*a*.

(4) The forging device 1 further includes the counter punch operation control mechanism 17 (the movement control mechanism). When the counter punch 15 is pressed against the shaft section end surface 3*a* to form the shaft section center hole 3*b* in the shaft section end surface 3*a*, the counter punch 15 reaches the specified position. At this time, the counter punch operation control mechanism 17 is configured to prohibit the counter punch 15 from moving beyond the specified position toward the object 2. According to the configuration just as described, the precision of the relative position in the axial direction of the shaft section center hole 3*b* to the head section end surface 4*a* is secured.

(5) The counter punch operation control mechanism 17 is configured to be switchable between the movement prohibition state and the movement permission state. In the movement prohibition state, once the counter punch 15 reaches the specified position, the counter punch 15 is prohibited from moving beyond the specified position toward the object 2. Meanwhile, in the movement permission state, even after the counter punch 15 reaches the specified position, the counter punch 15 is permitted to move beyond the specified position toward the object 2. According to the configuration just as described, when the counter punch operation control mechanism 17 is switched from the movement prohibition state to the movement permission state, the object 2 can be drawn out of the die hole 18 by using the counter punch 15.

(6) The counter punch operation control mechanism 17 is switched into the movement prohibition state in conjunction with the upper die 9 approaching the lower die 14. In addition, the counter punch operation control mechanism 17 is switched into the movement permission state in conjunction with the upper die 9 separating from the lower die 14. According to the configuration just as described, steps of switching the states of the counter punch operation control mechanism 17 can be saved.

In the above-described embodiment, when the shaft section center hole 3*b* is formed in the shaft section end surface 3*a* of the shaft section 3 of the object 2, a slight gap is formed between the shaft section 3 and the lower die 14 in the vicinity of the shaft section end surface 3*a*, so as to permit outward inflation of the shaft section 3 in a radial direction.

The invention claimed is:

1. A center hole forming method, comprising:

inserting an object to be processed in a die hole, the object including a shaft, a first axial end surface, and a second axial end surface, a diameter of the first axial end surface being smaller than a diameter of the second axial end surface;

applying a load to the second axial end surface in a direction toward the first axial end surface in a state that the object is inserted in the die hole, the load subjecting the shaft to shank extruding;

after the shank extruding, moving a counter punch toward the first axial end surface; and forming a center hole in the first axial end surface by pressing the counter punch against the first axial end surface while the load applied to the second axial end surface is maintained.

2. The center hole forming method according to claim 1, further comprising:

prohibiting the counter punch from moving beyond a specified position toward the object when the counter punch reaches the specified position while the counter punch is pressed against the first axial end surface to form the center hole in the first axial end surface.

3. The center hole forming method according to claim 1, wherein the hole is in a first die, the load is applied by a second die that moves toward the first die and presses the second axial end surface, and the center hole is formed by the counter punch after the second die contacts the first die.

4. A forging device, comprising:

a first die having a die hole;

a second die arranged at a large diameter side of the die hole and configured to apply a load to an object to subject a shaft of the object to shank extruding, the object being inserted in the die hole;

a die drive section configured to drive the second die;

a counter punch arranged at a small diameter side of the die hole and configured to be pressed against a first axial end surface of the object to form a center hole in the first axial end surface;

a counter punch drive section configured to drive the counter punch; and a controller configured to control the die drive section and the counter punch drive section, wherein the controller is configured to control the die drive section to apply the load to a second axial end surface of the object by the second die in a direction toward the first axial end surface, the load subjecting the shaft of the object to the shank extruding, the controller is configured to control the counter punch drive section to move the counter punch toward the first axial end surface after the shank extruding, the controller is configured to control the counter punch drive section to form the center hole in the first axial end surface by the counter punch while the load applied to the second axial end surface is maintained, and a diameter of the first axial end surface is smaller than a diameter of the second axial end surface.

5. The forging device according to claim 4, further comprising:

a movement control mechanism that is configured to prohibit the counter punch from moving beyond a specified position toward the object when the counter punch reaches the specified position while the counter punch is pressed against the first axial end surface to form the center hole in the first axial end surface.

6. The forging device according to claim 5, wherein the movement control mechanism is configured to be switchable between a movement prohibition state and a movement permission state, in the movement prohibition state, once the counter punch reaches the specified position, the counter punch is prohibited from moving beyond the specified position toward the object, and in the movement permission state, even after the counter punch reaches the specified position, the counter punch is permitted to move beyond the specified position toward the object.

7. The forging device according to claim 6, wherein the movement control mechanism is switched into the movement prohibition state in conjunction with the second die approaching the first die, and the movement control mechanism is switched into the movement permission state in conjunction with the second die separating from the first die.

8. The forging device according to claim 5, further comprising:

a movement control mechanism including a first moving block and a second moving block, the first moving block and the second moving block being provided in the first die, wherein the first moving block is movable in a direction that is perpendicular to an axial direction of the counter punch, the second moving block is movable in the axial direction, the first moving contacts the counter punch when the counter punch is located at the specified position in a state that the first die and the second die collide with each other.

9. The forging device according to claim 4, further comprising:

a movement control mechanism including a first moving block and a second moving block, the first moving block and the second moving block being provided in the first die, wherein the counter punch includes a small diameter part and a large diameter part, a diameter of the small diameter part being equal to or smaller than a diameter of an opening of the die hole, the opening being opposite the counter punch, a diameter of the large diameter part being larger than the diameter of the small diameter part, the first moving block is movable in a direction that is perpendicular to an axial direction of the counter punch, the second moving block is movable in the axial direction, the second moving block is configured to move in conjunction with movement of the second die, the first moving block is configured to move in conjunction with movement of the second moving block, and the first moving block is located in contact with an end surface of the large diameter part in the axial direction when the counter punch is located at the specified position in a state that the first die and the second die collide with each other.

10. The forging device according to claim 9, wherein a first inclined surface is formed at an end of the first moving block, a second inclined surface is formed at an end of the second moving block, and the first inclined surface and the second inclined surface are in contact with each other.

11. The forging device according to claim 10, wherein the movement control mechanism includes a rod and a spring, the rod is connected to the first moving block and penetrates the first die, the spring is arranged between a tip of the rod and an outer surface of the first die, and the spring is configured to be compressed and extended in conjunction with movement of the first moving block.

12. The forging device according to claim 9, wherein the movement control mechanism includes a rod and a spring, the rod is connected to the first moving block and penetrates the first die, the spring is arranged between a tip of the rod and an outer surface of the first die, and the spring is configured to be compressed and extended in conjunction with movement of the first moving block.

* * * * *